US006454523B1

(12) United States Patent
Loyd et al.

(10) Patent No.: US 6,454,523 B1
(45) Date of Patent: Sep. 24, 2002

(54) SPA WITH DOUBLE SEALED PUMP

(75) Inventors: Casey Loyd; Pedro Vargas, both of Pomona, CA (US)

(73) Assignee: California Acrylic Industries, Pomona, CA (US)

( * ) Notice: Subject to any disclaimer, the term of this patent is extended or adjusted under 35 U.S.C. 154(b) by 184 days.

(21) Appl. No.: 09/617,738

(22) Filed: Jul. 17, 2000

(51) Int. Cl.[7] ..... F01D 1/12

(52) U.S. Cl. ..... 415/58.4; 415/168.2; 415/206; 415/231

(58) Field of Search ..... 415/58.4, 168.2, 415/206; 417/231, 307; 277/358, 367, 408, 930, 928

(56) References Cited

U.S. PATENT DOCUMENTS

| | | | | | |
|---|---|---|---|---|---|
| 1,928,795 | A | * | 10/1933 | Reid | 384/150 |
| 2,430,509 | A | * | 11/1947 | Hoover | 277/500 |
| 2,646,001 | A | | 7/1953 | Ray | |
| 3,908,360 | A | | 9/1975 | Meyer et al. | |
| 3,954,348 | A | | 5/1976 | Renaud | |
| 4,560,173 | A | | 12/1985 | Adams et al. | |
| 4,594,500 | A | | 6/1986 | Wright | |
| 4,714,257 | A | * | 12/1987 | Heinrich et al. | 277/306 |
| 4,800,801 | A | | 1/1989 | van Zweeden | |
| 4,840,384 | A | | 6/1989 | Dorsch | |
| 4,915,579 | A | | 4/1990 | Whittier et al. | |
| 5,173,019 | A | | 12/1992 | Sdano | |
| 5,249,812 | A | * | 10/1993 | Volden et al. | 277/361 |
| 5,332,303 | A | | 7/1994 | Wupper | |
| 5,456,286 | A | | 10/1995 | Warner et al. | |
| 5,657,496 | A | | 8/1997 | Corb et al. | |
| 5,709,389 | A | | 1/1998 | Algers et al. | |
| 5,803,463 | A | | 9/1998 | Brooks et al. | |
| 5,938,207 | A | | 8/1999 | Marchionna et al. | |
| 6,015,268 | A | | 1/2000 | Hetherington | |
| 6,021,762 | A | | 2/2000 | Zeidler et al. | |
| 6,033,193 | A | | 3/2000 | Pieters et al. | |
| 6,050,788 | A | * | 4/2000 | McEwen et al. | 277/367 |

* cited by examiner

*Primary Examiner*—Edward K. Look
*Assistant Examiner*—Igor Kershteyn
(74) *Attorney, Agent, or Firm*—Sheldon & Mak; Denton L. Anderson

(57) ABSTRACT

A water pool apparatus, such as a portable spa, pool, hot tub or recirculating bath tub having a double seal configuration. The water pool apparatus has a water recirculation system which includes a centrifugal pump. The centrifugal pump has a double seal which includes a seal housing and a pair of spaced-apart seals. The seal housing defines an enclosed reservoir chamber. By the invention, any liquids which are successful in leaking past the first seal are trapped within the reservoir chamber. As the reservoir chamber accumulates liquid, the liquid can be recycled back into the water recirculation system by a drain conduit running between the reservoir chamber and the suction side of the pump.

11 Claims, 2 Drawing Sheets

SPA WITH DOUBLE SEALED PUMP

FIELD OF THE INVENTION

This invention relates generally to water recirculation pumps and, more specifically, to sealing devices used in water recirculation pumps.

BACKGROUND OF THE INVENTION

Water pool apparatuses, such as portable spas, portable pools, in-ground spas, in-ground pools, hot tubs, and recirculating bath tubs are enormously popular. Most such water pool apparatuses have a water recirculation system wherein water within the main water basin is recirculated through a filter and then back into the water basin by a centrifugal pump.

There is a problem with the use of centrifugal pumps for water pool apparatuses. This problem arises from the leakage of water at the impeller shaft pump seal. Such leakage is frequently detrimental to the efficient operation and life span of the pump, especially in water pool apparatuses wherein the recirculating water contains chlorine and/or other corrosive chemicals.

Accordingly, there is a need for a water pool apparatus recirculation pump seal which avoids the leakage problem experienced in the prior art.

SUMMARY OF THE INVENTION

The invention satisfies this need. The invention is a pump seal for sealing the impeller shaft of a centrifugal pump, especially centrifugal pumps used to recirculate water in a water pool apparatus. The pump seal of the invention comprises (a) seal housing for surrounding the impeller shaft, the housing comprising a forward end, a rearward end and a reservoir chamber disposed therebetween, the reservoir chamber having a drain port for discharging liquids from the reservoir chamber, (b) a forward sealing seat disposed at the forward end of the seal housing, (c) a forward seal element disposed around the impeller shaft and in abutment with the forward sealing seat, (d) a forward spring for urging the forward sealing element against the forward sealing seat so as to seal the impeller shaft from the flow of liquids therealong, (e) a rearward sealing seat disposed at the rearward end of the seal housing, (f) a rearward seal element disposed around the impeller shaft and in abutment with the rearward sealing seat, and (g) a rearward spring for urging the rearward sealing element against the rearward sealing seat so as to seal the impeller shaft from the flow of liquids therealong.

In a typical embodiment, the drain port on the reservoir chamber is disposed in fluid tight communication with the suction side of the centrifugal pump by a conduit which includes a check valve.

The invention has been found to be highly advantageous for centrifugal pumps used in the recirculation of chlorine-containing water from a water pool apparatus, such as a portable spa, swimming pool or recirculating bath tub.

DESCRIPTION OF THE DRAWINGS

These and other features, aspects and advantages of the present invention will become better understood with reference to the following description, appended claims and accompanying drawings where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figure 1:
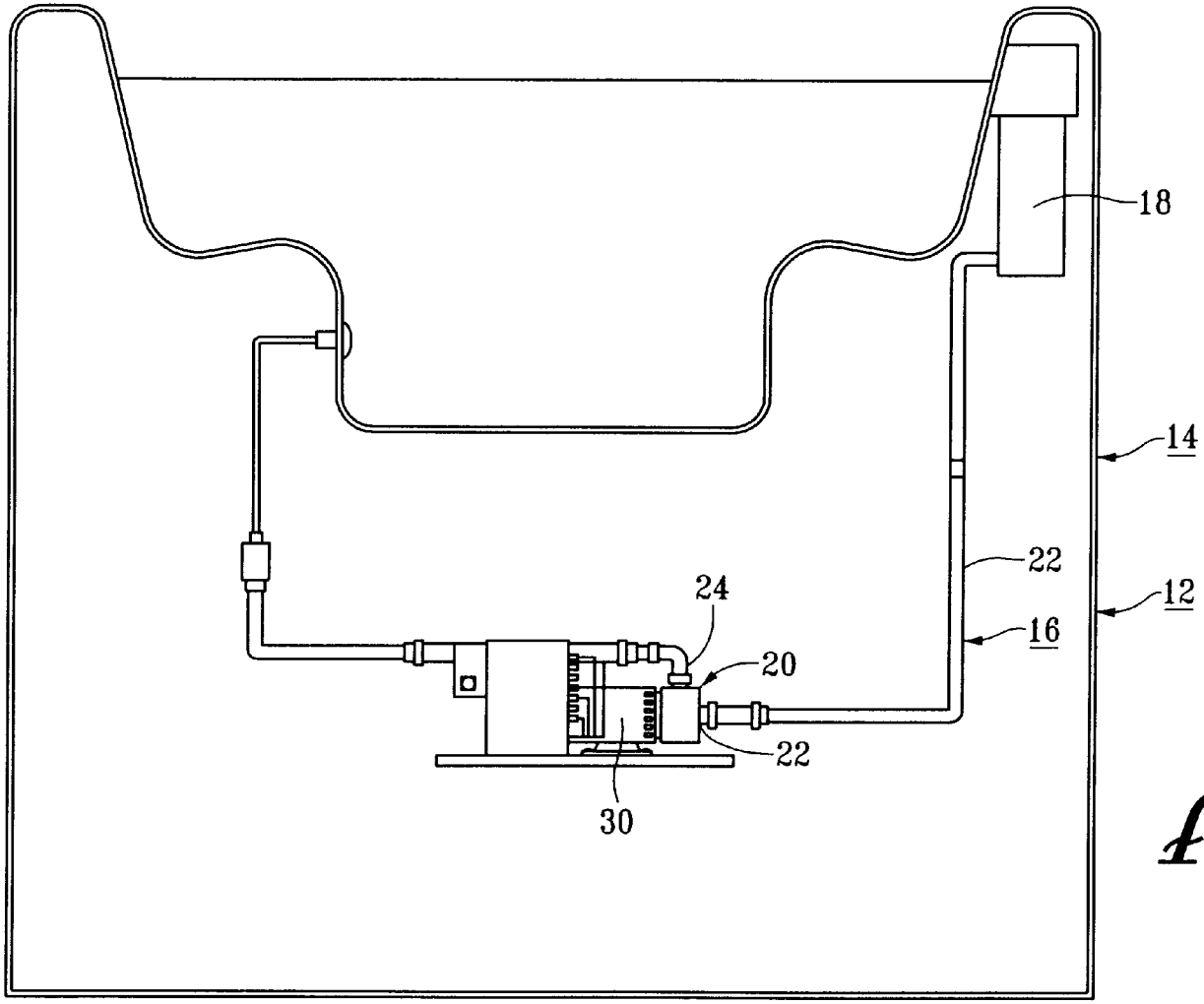
FIG. 1 is a diagrammatic view of a water pool apparatus useable in the invention.

The invention is a pump seal 10 having a "double seal" configuration. As illustrated in FIG. 1, the invention is especially useable in a water pool apparatus 12, such as a portable spa, portable pool, in-ground spa, in-ground pool, hot tub or recirculating bath tub.

The water pool apparatus 12 has an uncovered water basin 14 suitable for accepting one or more persons for bathing, recreation or relaxing purposes.

The water pool apparatus 12 also has a water recirculation system 16 which typically comprises a water filter 18 and drive means for recirculating the water from the water basin 12, through the water filter 18 and back into the water basin 12. Such drive means typically comprises a centrifugal recirculation pump 20 and connecting conduits 22.

Figure 2:
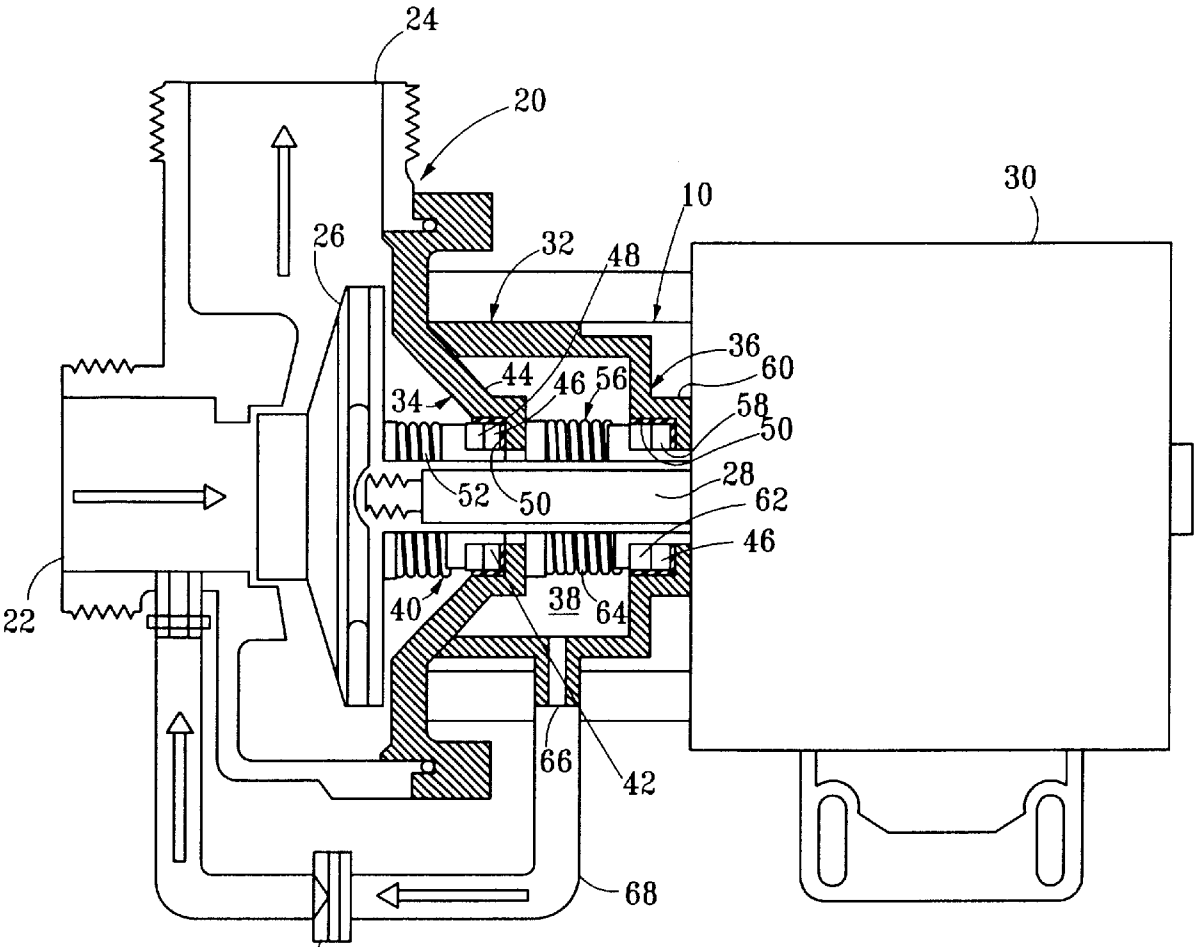
FIG. 2 is a cross-sectional side view of a pump seal having features of the invention.

As illustrated in FIG. 2, the recirculation pump 20 has a suction side 22 and a discharge side 24. The water recirculation pump 20 takes water from the suction side 22 and pumps it into the discharge side 24 using an impeller 26 disposed upon an impeller shaft 28 which is rotated at high speed by a pump motor 30.

The impeller shaft 28 is sealed from water leaking from the impeller 26 back along the impeller shaft 28 by the unique pump seal 10 of the invention.

The pump seal 10 comprises a seal housing 32 which surrounds the impeller shaft 28. The seal housing 32 comprises a forward end 34, a rearward end 36 and a reservoir chamber 38 disposed therebetween. The seal housing 32 is typically made from steel, although other rigid materials can be used as well.

A forward sealing system 40 is disposed at the forward end 34 of the seal housing 32. The forward seal system 40 comprises a forward sealing seat 42 disposed at the forward end 34 of the seal housing 32. In the embodiment illustrated in FIG. 2, the forward sealing seat 42 is defined by the walls 44 at the forward end 34 of the seal housing 32.

Preferably, the forward sealing seat 42 comprises a polished ceramic ring 46 disposed around the impeller shaft 28. The ceramic ring 46 is adapted to rotate with the impeller shaft 28. The ceramic ring 46 has a smooth outer surface which minimizes abrasion wear on the forward seal element 48 described immediately below. It is further preferable that the ceramic ring 46 be disposed within a rubber base 50 to maximize wear on the ceramic ring 46.

The forward seal element 48 is disposed around the impeller shaft 28 and is in abutment with the forward sealing seat 42.

The forward seal element 48 can be made from any of a wide variety of conventional sealing materials widely known in the industry. An especially useful sealing material for the forward seal element 48 is Viton, a hardened carbon material manufactured by Pack Seal of Burr Ridge, Ill.

A forward spring 52 is disposed between the impeller 26 and the forward seal element 48 to urge the forward seal element 48 into the forward sealing seat 42. By this action, the forward seal element 48 tightly seals the impeller shaft 28 to prevent most liquids from leaking rearwardly along the impeller shaft 28.

The invention employs a unique rearward sealing system 56 for further preventing the leakage of liquids from the impeller, rearwardly along the impeller shaft 28. In this rearward sealing system 56, a rearward sealing seat 58 is disposed at the rearward end 36 of the seal housing 32. In the embodiments illustrated in the drawings, the rearward sealing seat 58 is integral with the rear wall 60 of the seal housing 32.

As was the case with the forward sealing seat 42, the rearward sealing seat 58 preferably includes a polished ceramic ring 46 adapted to rotate with the impeller 28, and having a smooth forward surface for imparting minimum abrasive damage to the rearward seal element 62, described immediately below. Also as in the case of the forward sealing seat 42, it is preferable that the ceramic ring 46 in the rearward sealing seat 58 be disposed within a rubber base 50 to minimize wear on the ceramic ring 46.

The rearward seal element 62 is disposed around the impeller shaft 28 and is in abutment with the rearward sealing seat 58. The rearward seal element 62 can be made from any of a large number of sealing materials known in the industry. In one preferred embodiment, the rearward sealing element 62 is made from a silicon carbide, such as sealing elements sold by Pac Seal of Burr Ridge, Ill. under the trademark Pac Seal.

As is the case with the forward sealing element 42, the rearward sealing element 62 is urged into the rearward sealing seat 58 by a rearward spring 64.

In the embodiment illustrated in the drawings, the forward sealing system 40 is disposed forward of the seal housing 32 while the rearward sealing system 56 is disposed within the seal housing 32. This configuration is optional, however. In other embodiments, the forward sealing system 40 can be disposed within the seal housing 32 and/or the rearward seal sealing system 56 can be disposed rearward of the seal housing 32.

In all embodiments, liquids which leak rearwardly along the impeller shaft 28 and leak past the first sealing system 40 become trapped by the second sealing system 56 within the reservoir chamber 38.

To prevent the build-up of liquids within the reservoir chamber 38, a drain port 66 on the seal housing 32 is preferably disposed in fluid tight communication with the suction side 22 of the pump 20. In the embodiment illustrated in FIG. 2, this is accomplished using a drain conduit 68 running between the drain port 66 and the suction side 22 of the pump 20. A check valve 70 prevents liquids from flowing from the suction side 22 of the pump 20 backwards into the reservoir chamber 38.

The invention has been found to be highly advantageous in the prevention of liquid leakage of recirculating water within water pool apparatus. By the invention, the loss of water and water chemicals is prevented and the efficient operation and long-term life of the centrifugal pump are maximized.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A pump seal for sealing the impeller shaft of a centrifugal pump, the pump seal comprising:

(a) a seal housing for surrounding the impeller shaft, the housing comprising a forward end, a rearward end and a reservoir chamber disposed therebetween, the reservoir chamber having a drain port for discharging liquids from the reservoir chamber;

(b) a forward sealing seat disposed at the forward end of the seal housing;

(c) a forward seal element disposed around the impeller shaft and in abutment with the forward sealing seat;

(d) a forward spring for urging the forward sealing element against the forward sealing seat so as to seal the impeller shaft from the flow of liquids therealong;

(e) a rearward sealing seat disposed at the rearward end of the seal housing;

(f) a rearward seal element disposed around the impeller shaft and in abutment with the rearward sealing seat; and (g) a rearward spring for urging the rearward sealing element against the rearward sealing seat so as to seal the impeller shaft from the flow of liquids therealong;

wherein the centrifugal pump has a suction side and a discharge side, wherein the pump seal is disposed around the impeller shaft and wherein the drain port is disposed in fluid tight communication with the suction side of the pump.

2. The pump seal of claim 1 wherein both the forward sealing seat and the rearward sealing seat comprise a sealing surface and a ceramic ring disposed in abutment with the sealing surface.

3. The pump seal of claim 1 wherein the forward sealing element is made of Viton.

4. The pump seal of claim 1 wherein the rearward sealing element is made of silicon carbide.

5. The pump seal of claim 1 wherein a drain conduit is disposed in fluid communication between the drain port and the suction side of the centrifugal pump, the drain conduit including a check valve.

6. A water pool apparatus having an uncovered water basin suitable for accepting one or more persons and a water recirculation system for recirculating water from the water basin, through a water filter and back to the water basin using a centrifugal pump, the centrifugal pump having an impeller mounted on an impeller shaft, wherein the impeller shaft is sealed by a pump seal comprising:

(a) a seal housing for surrounding the impeller shaft, the housing comprising a forward end, a rearward end and a reservoir chamber disposed therebetween, the reservoir chamber having a drain port for discharging liquids from the reservoir chamber;

(b) a forward sealing seat disposed at the forward end of the seal housing;

(c) a forward seal element disposed around the impeller shaft and in abutment with the forward sealing seat;

(d) a forward spring for urging the forward sealing element against the forward sealing seat so as to seal the impeller shaft from the flow of liquids therealong;

(e) a rearward sealing seat disposed at the rearward end of the seal housing;

(f) a rearward seal element disposed around the impeller shaft and in abutment with the rearward sealing seat; and (g) a rearward spring for urging the rearward sealing element against the rearward sealing seat so as to seal the impeller shaft from the flow of liquids therealong;

wherein the centrifugal pump has a suction side and a discharge side, wherein the pump seal is disposed around the impeller shaft and wherein the drain port is disposed in fluid tight communication with the suction side of the pump.

7. The water pool apparatus of claim 6 wherein both the forward sealing seat and the rearward sealing seat comprise a sealing surface and a ceramic ring disposed in abutment with the sealing surface.

8. The water pool apparatus of claim 6 wherein the forward sealing element is made of Viton.

9. The water pool apparatus of claim 8 wherein a drain conduit is disposed in fluid communication between the drain port and the suction side of the centrifugal pump, the drain conduit including a check valve.

10. The water pool apparatus of claim 6 wherein the rearward sealing element is made of silicon carbide.

11. A pump seal for sealing the impeller shaft of a centrifugal pump, the pump seal comprising:

(a) a seal housing for surrounding the impeller shaft, the housing comprising a forward end, a rearward end and a reservoir chamber disposed therebetween, the reservoir chamber having a drain port for discharging liquids from the reservoir chamber;

(b) a forward sealing seat disposed at the forward end of the seal housing;

(c) a forward seal element disposed around the impeller shaft and in abutment with the forward sealing seat, the forward seal element being made of Viton;

(d) a forward spring for urging the forward sealing element against the forward sealing seat so as to seal the impeller shaft from the flow of liquids therealong;

(e) a rearward sealing seat disposed at the rearward end of the seal housing;

(f) a rearward seal element disposed around the impeller shaft and in abutment with the rearward sealing seat; and (g) a rearward spring for urging the rearward sealing element against the rearward sealing seat so as to seal the impeller shaft from the flow of liquids therealong.

* * * * *